US011130135B2

(12) United States Patent
Dong et al.

(10) Patent No.: US 11,130,135 B2
(45) Date of Patent: Sep. 28, 2021

(54) MICROFLUIDIC SYSTEM AND DRIVING METHOD THEREOF

(71) Applicant: BOE TECHNOLOGY GROUP CO., LTD., Beijing (CN)

(72) Inventors: Xue Dong, Beijing (CN); Haisheng Wang, Beijing (CN); Xiaoliang Ding, Beijing (CN); Yingming Liu, Beijing (CN); Yanling Han, Beijing (CN); Yuzhen Guo, Beijing (CN); Wei Liu, Beijing (CN); Xueyou Cao, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 495 days.

(21) Appl. No.: 15/977,733

(22) Filed: May 11, 2018

(65) Prior Publication Data

US 2019/0105655 A1 Apr. 11, 2019

(30) Foreign Application Priority Data

Oct. 11, 2017 (CN) ..... 201710941682.X

(51) Int. Cl.
*B01L 3/00* (2006.01)
*G09G 3/34* (2006.01)

(52) U.S. Cl.
CPC ..... *B01L 3/502792* (2013.01); *B01L 3/50273* (2013.01); *G09G 3/3446* (2013.01); (Continued)

(58) Field of Classification Search
CPC ..... B01L 2200/143; B01L 2400/0427; B01L 3/502707; B01L 3/502792; (Continued)

(56) References Cited

U.S. PATENT DOCUMENTS

2011/0247938 A1* 10/2011 Wang ..... B01L 3/502792 204/603
2014/0054174 A1 2/2014 Wang
2016/0059232 A1 3/2016 Muelleder et al.

FOREIGN PATENT DOCUMENTS

CN 101773814 A 7/2010
CN 102650512 A 8/2012
(Continued)

OTHER PUBLICATIONS

First Office Action, including Search Report, for Chinese Patent Application No. 201710941682.X, dated Mar. 21, 2019, 17 pages.

*Primary Examiner* — Dean Kwak
(74) *Attorney, Agent, or Firm* — Westman, Champlin & Koehler, P.A.

(57) ABSTRACT

A microfluidic system is disclosed, including: a first substrate, a second substrate and a droplet flow channel arranged therebetween; a droplet driving unit configured to drive a droplet to move; a first control circuit electrically connected to the droplet driving unit and configured to input a first driving signal to the droplet driving unit to enable the droplet to move along the predetermined movement trajectory; a droplet detection unit configured to detect the droplet and output a detection signal; a second control circuit electrically connected to the droplet detection unit and configured to receive the detection signal and acquire an actual movement trajectory of the droplet; and a signal adjustment unit configured to compare the actual movement trajectory with the predetermined movement trajectory, and if the actual movement trajectory is different from the predetermined movement trajectory, adjust in real time the first driving signal into a second driving signal.

15 Claims, 5 Drawing Sheets

(52) U.S. Cl.
CPC . *B01L 3/502707* (2013.01); *B01L 2200/0605* (2013.01); *B01L 2200/143* (2013.01); *B01L 2300/0654* (2013.01); *B01L 2300/0819* (2013.01); *B01L 2400/0427* (2013.01)

(58) Field of Classification Search
CPC ..... B01L 2200/0605; B01L 2300/0645; B01L 2300/0819; B01L 3/50273; G01N 27/48; G02B 26/005
See application file for complete search history.

(56) References Cited

FOREIGN PATENT DOCUMENTS

| | | | |
|---|---|---|---|
| CN | 102671724 | A | 9/2012 |
| CN | 104035796 | A | 9/2014 |
| CN | 104903003 | A | 9/2015 |
| CN | 105142790 | A | 12/2015 |
| CN | 105413765 | A | 3/2016 |
| CN | 106432767 | A | 2/2017 |
| CN | 106933142 | A | 7/2017 |

* cited by examiner

MICROFLUIDIC SYSTEM AND DRIVING METHOD THEREOF

CROSS-REFERENCE TO RELATED APPLICATION

The present application claims a priority to Chinese Patent Application No. 201710941682.X filed on Oct. 11, 2017, the disclosure of which is incorporated in its entirety by reference herein.

TECHNICAL FIELD

The present disclosure relates to a microfluidic system and a driving method thereof.

BACKGROUND

Microfluidics is a technology for manipulating a single microfluidic droplet using various driving modes such as light, heat, voltage and surface acoustic wave to achieve such functions as sampling, mixing, transporting and detecting the microfluidic droplets.

SUMMARY

The present disclosure provides a microfluidic system and a driving method thereof.

In one aspect, the present disclosure provides in some embodiments a microfluidic system. The microfluidic system includes: a first substrate; a second substrate arranged opposite to the first substrate; a droplet flow channel arranged between the first substrate and the second substrate and configured to accommodate a droplet therein; a droplet driving unit configured to drive the droplet to move in the droplet flow channel; a first control circuit electrically connected to the droplet driving unit and configured to input a first driving signal to the droplet driving unit to drive the droplet to move along a predetermined movement trajectory; a droplet detection unit configured to detect the droplet and output a detection signal; a second control circuit electrically connected to the droplet detection unit and configured to receive the detection signal and acquire an actual movement trajectory of the droplet; and a signal adjustment unit configured to compare the actual movement trajectory with the predetermined movement trajectory, and in the case that the actual movement trajectory is different from the predetermined movement trajectory, adjust, in a real-time manner, the first driving signal inputted to the droplet driving unit into a second driving signal in such a manner that the droplet moves back to the predetermined movement trajectory under the effect of the second driving signal.

In another aspect, the present disclosure provides in some embodiments a driving method for the above-mentioned microfluidic system. The driving method includes: inputting, by the first control circuit, the first driving signal to the droplet driving unit to drive the droplet to move in the droplet flow channel along the predetermined movement trajectory; inputting a detection driving signal to the droplet detection unit, detecting, by the droplet detection unit, the droplet and outputting the detection signal, and receiving, by the second control circuit, the detection signal and acquiring the actual movement trajectory of the droplet in accordance with the detection signal; and comparing, by the signal adjustment unit, the actual movement trajectory with the predetermined movement trajectory, and in the case that the actual movement trajectory is different from the predetermined movement trajectory, adjusting, in a real-time manner, by the signal adjustment unit, the first driving signal inputted to the droplet driving unit into the second driving signal in such a manner that the droplet moves back to the predetermined movement trajectory under the effect of the second driving signal.

BRIEF DESCRIPTION OF THE DRAWINGS

In order to illustrate the technical solutions of the present disclosure or the related art clearer, the drawings of the present disclosure or the related art will be described hereinafter briefly. Obviously, the following drawings merely relate to some embodiments of the present disclosure, and based on these drawings, a person skilled in the art may obtain the other drawings without any creative effort.

DETAILED DESCRIPTION OF THE EMBODIMENTS

In order to make the objects, the technical solutions and the advantages of the present disclosure more apparent, the present disclosure will be described hereinafter in a clear and complete manner in conjunction with the drawings and embodiments. Obviously, the following embodiments merely relate to a part of, rather than all of the embodiments of the present disclosure, and based on these embodiments, a person skilled in the art may, without any creative effort, obtain the other embodiments, which also fall within the scope of the present disclosure.

Unless otherwise defined, any technical or scientific terms used herein shall have the common meaning understood by a person of ordinary skills. Such words as "first" and "second" used in the specification and claims are merely used to differentiate different components rather than to represent any order, number or importance. Similarly, such words as "one" or "one of" are merely used to represent the existence of at least one member, rather than to limit the number thereof. Such words as "connect" or "connected to" may include electrical connection, direct or indirect, rather than to be limited to physical or mechanical connection. Such words as "on", "under", "left" and "right" are merely used to represent relative position relationship, and when an absolute position of the object is changed, the relative position relationship will be changed too.

Currently, microfluidics has been advantageously applied to various fields, specially chemistry and medicine, so as to control movement, separation and combination, and reaction of droplets.

For electrowetting-on-dielectric (EWOD)-based microfluidics, a voltage signal is applied to a chip containing an insulation dielectric layer, so as to change a contact angle of the droplet on the insulation dielectric layer and enable the droplet to be deformed asymmetrically, thereby manipulating the droplet through an internal force. Due to such advantages as being easily implemented and conveniently manipulated, excellent controllability and high driving capability, this technology has attracted more and more attentions and has been considered as the most promising technology in the field of microfluidic.

Currently, there have already existed many chip-based systems for controlling the droplet mainly through detecting an impedance of the droplet.

Figure 1:
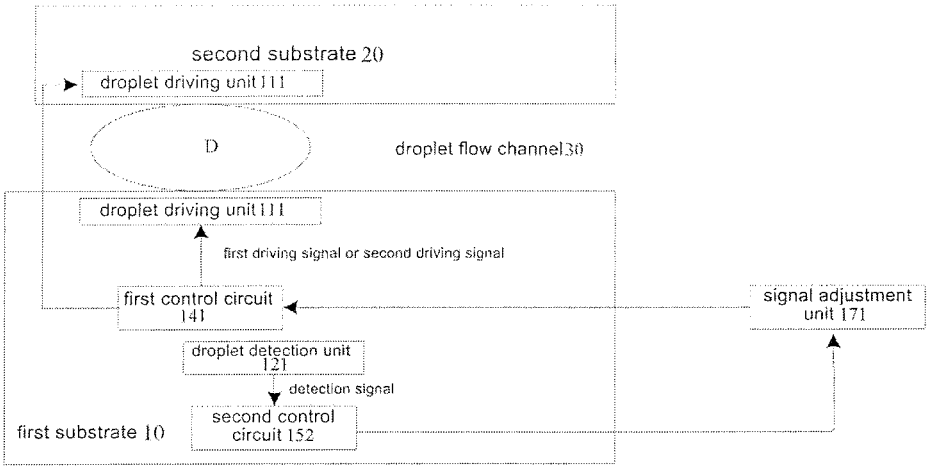
FIG. 1 is a schematic view showing a microfluidic system according to some embodiments of the present disclosure.

As shown in FIG. 1, the present disclosure provides in some embodiments a microfluidic system. The microfluidic system includes: a first substrate 10; a second substrate 20 arranged opposite to the first substrate 10; a droplet flow channel 30 arranged between the first substrate 10 and the second substrate 20 and configured to accommodate a droplet D; a droplet driving unit 111 configured to drive the droplet D to move; a first control circuit 141 electrically connected to the droplet driving unit 111 and configured to input a first driving signal to the droplet driving unit 111 to drive the droplet to move along a predetermined movement trajectory (e.g., a predetermined droplet movement trajectory); a droplet detection unit 121 configured to detect the droplet and output a detection signal; a second control circuit 152 electrically connected to the droplet detection unit 121 and configured to receive the detection signal to acquire an actual movement trajectory of the droplet; and a signal adjustment unit 171 configured to compare the actual movement trajectory of the droplet and the predetermined movement trajectory, and in the case that the actual movement trajectory is different from the predetermined movement trajectory, adjust in real time the first driving signal inputted to the droplet driving unit 111 into a second driving signal (an adjusted driving signal), so as to enable the droplet to move along the predetermined movement trajectory again under the effect of the second driving signal.

For example, the droplet detection unit 121 may be configured to detect at least one of a position or a size of the droplet. According to the microfluidic system in the embodiments of the present disclosure, in the case that the actual movement trajectory of the droplet is different from the predetermined movement trajectory, the signal adjustment unit 171 may adjust the signal in accordance with at least one of the position or the size of the droplet so as to acquire the second driving signal and enable the droplet to move along the predetermined movement trajectory again under the effect of the second driving signal, thereby controlling the droplet in an accurate manner.

Figure 2:
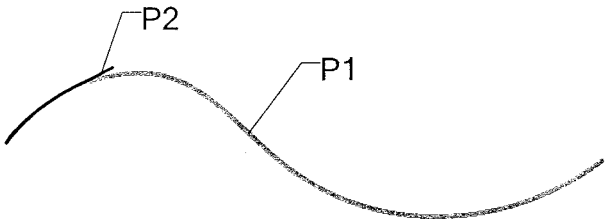
FIG. 2 is a schematic view showing a situation where a droplet in a microfluidic system moves along a movement trajectory deviated from a predetermined movement trajectory according to some embodiments of the present disclosure.

FIG. 2 schematically shows the predetermined movement trajectory P1 and the actual movement trajectory P2 of the droplet according to some embodiments. In the case that the actual movement trajectory P2 is different from the predetermined movement trajectory P1, the signal adjustment unit 171 may adjust in real time the driving signal inputted to the droplet driving unit 111, so as to enable the droplet to move along the predetermined movement trajectory P1 again.

Figure 3A:
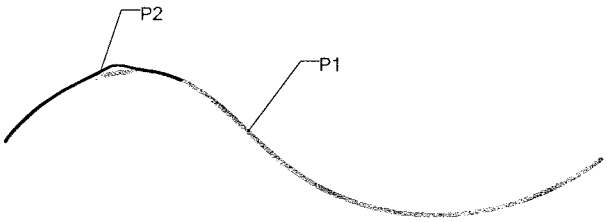
FIG. 3A is a schematic view showing a situation where a droplet in a microfluidic system moves back to a predetermined movement trajectory according to some embodiments of the present disclosure.

FIG. 3A schematically shows a situation where the droplet moves back to the predetermined movement trajectory P1 after the adjustment of the driving signal inputted to the droplet driving unit 111 according to some embodiments.

Figure 3B:
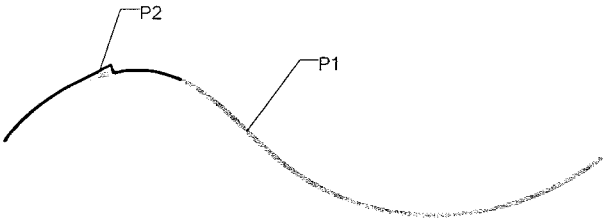
FIG. 3B is a schematic view showing a situation where a droplet in a microfluidic system moves back to the predetermined movement trajectory according to some other embodiments of the present disclosure.

FIG. 3B schematically shows a situation where the droplet moves back to the predetermined movement trajectory P1 after the adjustment of the driving signal inputted to the droplet driving unit 111 according to some other embodiments.

It should be appreciated that, FIGS. 2, 3A and 3B schematically show the predetermined movement trajectory P1, the actual movement trajectory P2 and an adjusted movement trajectory under the effect of the second driving signal from the droplet driving unit 111. In the embodiments of the present disclosure, the predetermined movement trajectory P1 of the droplet may be set in accordance with the practical need.

According to the microfluidic system in the embodiments of the present disclosure, it is able to monitor the droplet in real time and meanwhile control the movement of the droplet in real time, e.g., to detect at least one of the position or the size of the droplet. As a result, it is able to adjust in real time the movement trajectory of the droplet, and control the movement of the droplet in a more accurate manner. For example, for chemical synthesis, it is able to accurately guide the droplets to a given region, so as to facilitate the chemical reaction.

Figure 4:
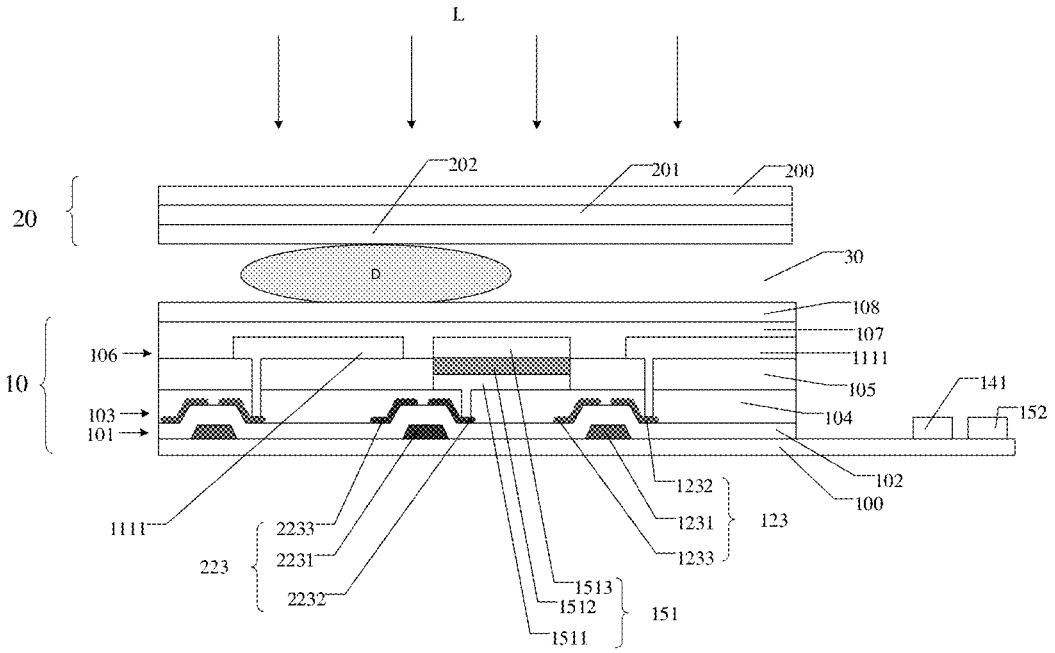
FIG. 4 is a sectional view of a microfluidic system according to some embodiments of the present disclosure.

As shown in FIG. 4, the droplet detection unit 121 is arranged on the first substrate 10 and includes a plurality of detection sub-units 151 (one of which is merely shown in FIG. 4). Each detection sub-unit 151 includes a photosensitive sensor configured to detect a change in an intensity of a light beam received by the photosensitive sensor.

For example, a passive light source, e.g., an ambient light beam, or an active light source may be adopted. FIG. 4 shows a light beam L illuminating the microfluidic system.

In the case that the droplet moves to a certain position, the intensity of the light beam passing through the droplet may change, and the detection sub-unit 151 at the position where the droplet is located may receive the light beam whose intensity has been changed. However, the detection sub-unit 151 at a position where no droplet is located may receive the light beam whose intensity has not been changed. As a result, it is able to determine at least one of the position or the size of the droplet.

As shown in FIG. 4, the droplet driving unit 111 includes a first electrode and a second electrode 201 which are configured to generate an electric field to adjust a contact angle of the droplet, thereby to drive the droplet to move. The first electrode is arranged on the first substrate 10, and the second electrode 201 is arranged on the second substrate 20. Through the electric field between the first substrate 10 and the second substrate 20, it is able to drive the droplet to move in the droplet flow channel.

As shown in FIG. 4, the first electrode may include a plurality of first sub-electrodes 1111 insulated from each other. In an optional embodiment of the present disclosure, the second electrode 201 is configured to receive a reference voltage such as a common voltage or be grounded. A driving signal may be applied to each first sub-electrode 1111, so as to drive the droplet to move. The second electrode 201 may be of a plate-like shape, or it may include a plurality of second sub-electrodes insulated from each other.

As shown in FIG. 4, the microfluidic system further includes a plurality of first thin film transistors (TFT) 123 electrically connected to the first sub-electrodes 1111 in a one-to-one correspondence and a plurality of second TFTs 223 electrically connected to the detection sub-units 151 in a one-to-one correspondence. The first TFT 123 and the second TFT 223 may be arranged at a same layer, so as to simplify the manufacture process and improve the production efficiency.

As shown in FIG. 4, the first TFT 123 includes a first gate electrode 1231, a first drain electrode 1232 and a first source electrode 1233, and the second TFT 223 includes a second gate electrode 2231, a second drain electrode 2232 and a second source electrode 2233. In an optional embodiment of the present disclosure, the first gate electrode 1231 and the second gate electrode 2231 may be arranged in a same layer, e.g., a gate electrode layer 101. The first drain electrode 1232, the first source electrode 1233, the second drain electrode 2232 and the second source electrode 2233 may be arranged in a same layer, e.g., a source and drain electrode layer 103.

As shown in FIG. 4, each detection sub-unit 151 is a photosensitive sensor which includes a third electrode 1511, a fourth electrode 1513 and a photosensitive layer 1512 electrically connected to the third electrode 1511 and the fourth electrode 1513. The third electrode 1511 is electrically connected to the second drain electrode 2232 of the second TFT 223. The fourth electrodes 1513 and the first electrode may be arranged at a same layer, e.g., an electrode layer 106, so as to simplify the manufacture process and improve the production efficiency. The photosensitive layer 1512 may be made of a semiconductor material, including, but not limited to, amorphous silicon and poly-silicon (e.g., low-temperature poly-silicon). The photosensitive sensor may include, but not limited to, a PIN photodiode. The third electrode 1511 may be a cathode, and the fourth electrode 1513 may be an anode.

As shown in FIG. 4, the first substrate 10 includes a first base substrate 100, and the second substrate 20 includes a second base substrate 200. Each of the first base substrate 100 and the second base substrate 200 may be a glass substrate, so as to facilitate the manufacture of the microfluidic system on the basis of the manufacture process of the glass substrate. In addition, the microfluidic system may be integrated into the glass substrate. Of course, each of the first base substrate 100 and the second base substrate 200 may not be limited to the glass substrate.

As shown in FIG. 4, the first substrate 10 further includes a gate insulation layer 102, a first insulation layer 104, a second insulation layer 105 and a third insulation layer 107, each of which is made of an insulation material including, but not limited to, at least one of SiOx, SiNy or SiOxNy.

As shown in FIG. 4, a first hydrophobic layer 108 is arranged on the first base substrate 100 and a second hydrophobic layer 202 is arranged on the second base substrate 200, so as to facilitate the change of the contact angle of the droplet, thereby facilitating the movement of the droplet under the control of the EWOD microfluidic system. The first hydrophobic layer 108 is arranged at a side of the first substrate 10 adjacent to the droplet flow passage 30, and the second hydrophobic layer 202 is arranged at a side of the second substrate 20 adjacent to the first substrate 10.

As shown in FIG. 4, the first substrate 10 includes the base substrate 100, the gate electrode layer 101, the gate insulation layer 102, the source and drain electrode layer 103, the first insulation layer 104, the second insulation layer 105, the electrode layer 106, the third insulation layer 107 and the first hydrophobic layer 108, which are stacked in sequence. The first gate electrode 1231 and the second gate electrode 2231 are arranged at the gate electrode layer 101. The first drain electrode 1232, the first source electrode 1233, the second drain electrode 2232 and the second source electrode 2233 are arranged at the source and drain electrode layer 103. The fourth electrode 1513 and the first electrode are arranged at the electrode layer 106.

Figure 5:
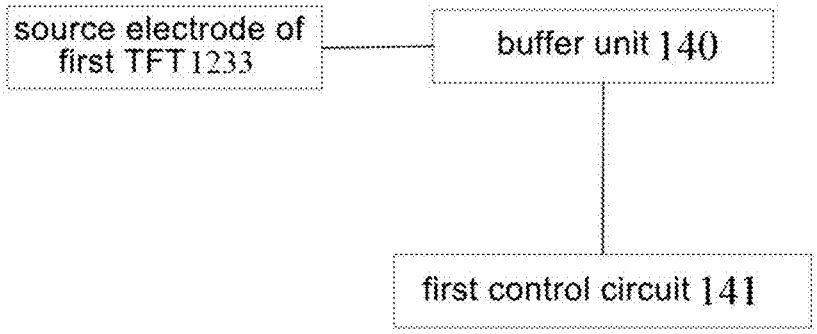
FIG. 5 is a schematic view showing part of a microfluidic system with a buffer unit according to some embodiments of the present disclosure.

As shown in FIG. 5, the microfluidic system further includes a buffer unit 140 electrically connected to the first source electrode 1233 of the first TFT and the first control circuit and configured to amplify the first driving signal or the second driving signal from the first control circuit.

Figure 6:
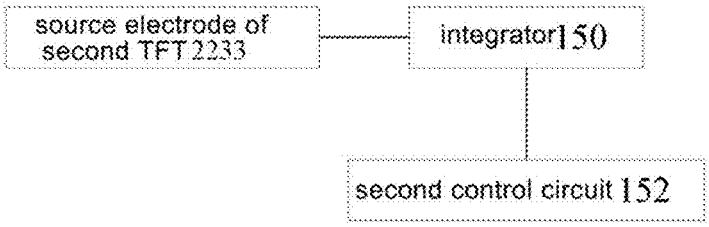
FIG. 6 is a schematic view showing part of a microfluidic system with an integrator according to some embodiments of the present disclosure.

As shown in FIG. 6, the microfluidic system further includes an integrator 150 electrically connected to the second source electrode 2233 of the second TFT and the second control circuit 152 and configured to perform analog-to-digital conversion on the detection signal received by the second control circuit 152.

Figure 7:
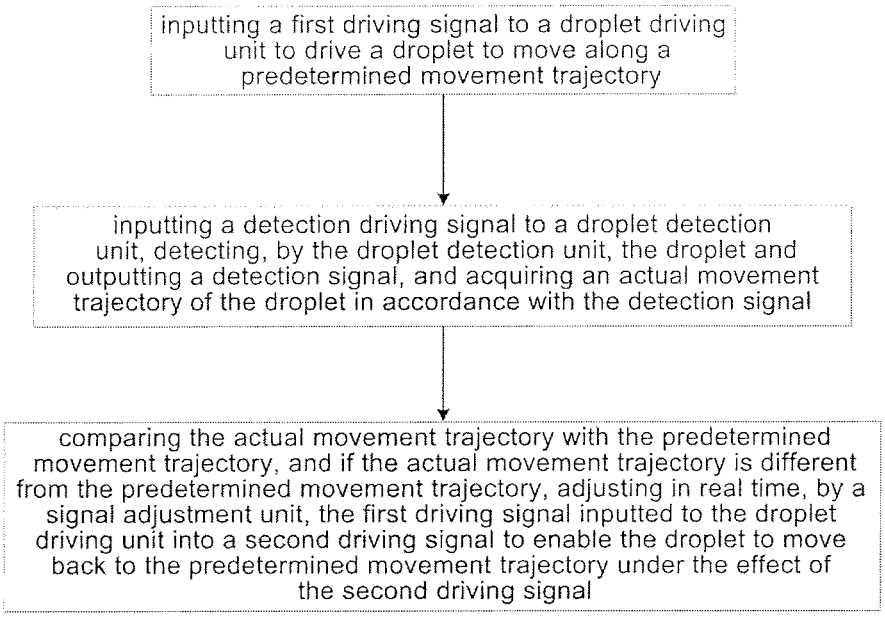
FIG. 7 is a flow chart of a driving method for a microfluidic system according to some embodiments of the present disclosure.

As shown in FIG. 7, the present disclosure further provides in some embodiments a driving method for the above-mentioned microfluidic system. The driving method includes: inputting the first driving signal to the droplet driving unit 111 to drive the droplet to move along the predetermined movement trajectory; inputting a detection driving signal to the droplet detection unit 121 (e.g., inputting a gate signal to the second TFT 223), detecting, by the droplet detection unit 121, the droplet and outputting the detection signal (e.g., detecting, by the photosensitive layer, an optical signal and outputting the detection signal), and acquiring the actual movement trajectory in accordance with the detection signal; and comparing the actual movement trajectory with the predetermined movement trajectory, and in the case that the actual movement trajectory is different from the predetermined movement trajectory, adjusting in real time, by the signal adjustment unit 171, the first driving signal inputted to the droplet driving unit 111 into the second driving signal, so as to enable the droplet to move along the predetermined movement trajectory again under the effect of the second driving signal.

According to the microfluidic system and the driving method thereof in the embodiments of the present disclosure, it is able to monitor in real time the position and the size of the droplet and meanwhile control in real time the movement of the droplet, e.g., to drive the droplet to move in a dual-electrode manner and detect the droplet using a PIN photosensitive material. The droplet itself may function as a lens, and its refractive index is different from that of the air or any other material. In the case that the droplet is illuminated with an ambient light beam or a light beam form an active light source, an optical path and optical energy of the light beam passing through the droplet may change. Hence, it is able to detect the change in the light beam using the PIN photosensitive material, so as to determine the position and the size of the droplet. In addition, an operating state of each first sub-electrode (i.e., a driving electrode) may be adjusted, so as to enable the droplet to move along the predetermined movement trajectory.

In an optional embodiment of the present disclosure, the driving method further includes increasing a driving capability of the first driving signal or the second driving signal.

In an optional embodiment of the present disclosure, the driving method further includes performing analog-to-digital conversion on the detection signal.

Figure 8A:
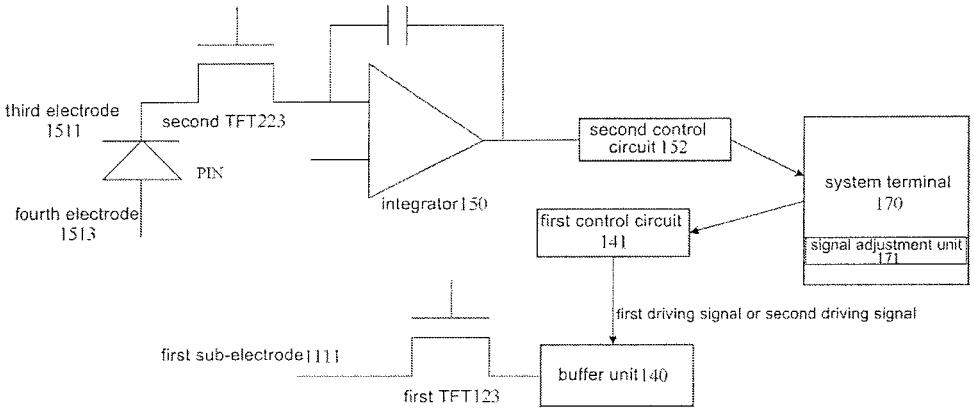
FIG. 8A is a schematic view showing a connection relationship among part of members of a microfluidic system according to some embodiments of the present disclosure.

FIG. 8A is a schematic view showing a connection relationship among part of members of the microfluidic system. As shown in FIGS. 4 and 8A, the PIN photodiode may be negatively biased, so as to receive the light beam and generate a photocurrent in a linear manner. The second TFT 223 may be turned on, so as to allow the photocurrent induced by the PIN photodiode to flow to the integrator 150. The integrator 150 may perform the analog-to-digital conversion on a collected current signal, and transmit the resultant signal to the second control circuit 152. The second control circuit 152 may transmit the signal to a system terminal 170, so as to display at the system terminal the position and the size of the droplet. In addition, the actual movement trajectory may be compared with the predetermined movement trajectory at the system terminal 170. In the case that the actual movement trajectory is different from the predetermined movement trajectory, the signal adjustment unit 171 of the system terminal 170 may adjust in real time the first driving signal inputted to the droplet driving unit into the second driving signal, so as to enable the droplet to move along the predetermined movement trajectory again. A control signal may be outputted by the system terminal 170 to the first control circuit 141 so as to adjust in real time the first driving signal into the second driving signal, and then the buffer unit 140 may increase the driving capability of the second driving signal. Through controlling a gate signal applied to the first TFT 123, the second driving signal may be transmitted to the first sub-electrode 1111 (the driving electrode) as required, so as to generate a potential difference between the first sub-electrode 1111 and the second electrode 201 on the second base substrate 200, thereby changing a surface tension of the droplet and drive the droplet to move. In the case that the actual movement trajectory is the same as the predetermined movement trajectory, the first driving signal (i.e., a predetermined driving signal) may be outputted by the first control circuit 141 to the droplet driving unit 111, e.g., to the first sub-electrode 1111.

In an optional embodiment of the present disclosure, each of the first control circuit 141 and the second control circuit 152 may include, but not limited to, a single chip microcomputer (SCM), e.g., a field-programmable gate array (FPGA). The first control circuit 141 may include, but not limited to, a driving circuit, and the second control circuit 152 may include, but not limited to, a collection circuit.

Figure 8B:
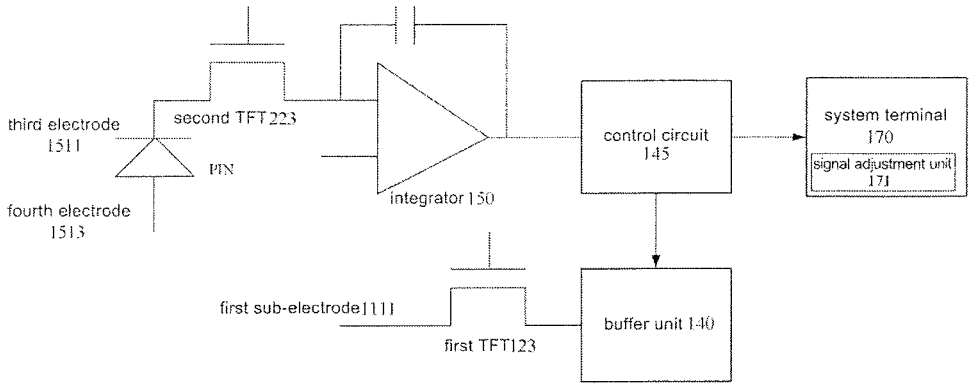
FIG. 8B is a schematic view showing a connection relationship among part of members of a microfluidic system according to some other embodiments of the present disclosure.

As shown in FIG. 8B, the first control circuit 141 and the second control circuit 152 are integrated into a control circuit 145.

In an optional embodiment of the present disclosure, the PIN photodiodes of the droplet detection unit 121 and the second TFTs 223 may each be of an individual collection module, and they may be arranged in an array form, and the first TFTs 123 may also be arranged in an array form, so as to extend the microfluidic system. In addition, the collection system and the control system may cooperate with each other, so as to accurately control the droplet in real time.

Figure 9A:
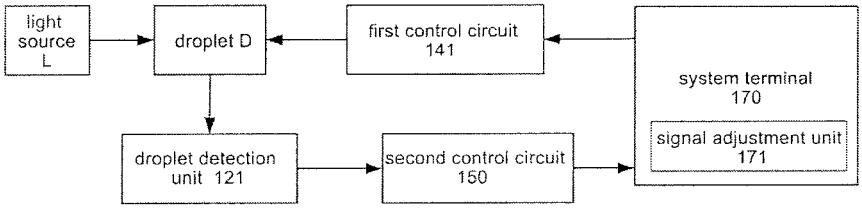
FIG. 9A is a schematic view showing an operating principle of a microfluidic system according to some embodiments of the present disclosure.

FIG. 9A shows an operating principle of the driving method. The signal adjustment unit 171 may be arranged at the system terminal 170, and the system terminal 170 may include, but not limited to, a personal computer (PC).

As shown in FIG. 9A, the droplet detection unit 121 may be a collection module. The collected signal may be processed by the second control circuit 152 (a collection integrated circuit (IC)), and then the resultant data may be transmitted to, and displayed by, the system terminal 170, so as to acquire the actual movement trajectory (an actual position) of the droplet. The system terminal 170 may compare the actual movement trajectory (the actual position) with the predetermined movement trajectory. In the case that the actual movement trajectory is different from the predetermined movement trajectory, the signal adjustment unit 171 may adjust in real time the first driving signal inputted to the droplet driving unit into the second driving signal, so as to enable the droplet to move along the predetermined movement trajectory again. The control signal may be transmitted by the system terminal 170 to the first control circuit 141, so as to adjust the driving signal, thereby to control the droplet in real time.

Figure 9B:
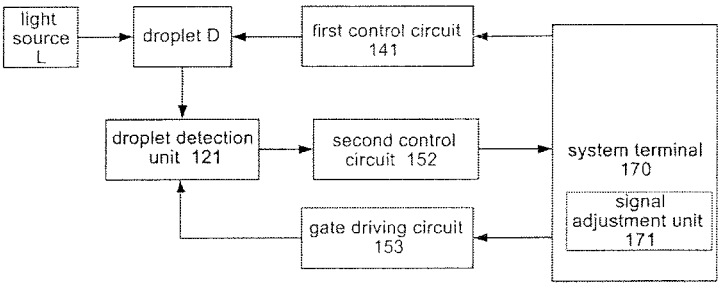
FIG. 9B is a schematic view showing an operating principle of a microfluidic system according to some other embodiments of the present disclosure.

In an optional embodiment of the present disclosure, as shown in FIG. 9B, the microfluidic system may further include a gate driving circuit 153 configured to turn on or off the second TFT 223 of the droplet detection unit 121 during collection. Of course, another gate driving circuit may also be provided so as to turn on or off the first TFT 123 of the droplet driving unit 111 during the movement of the droplet.

In actual applications, a light beam from a passive light source, e.g., an ambient light beam, or a light beam from an active light source may be adopted. In the case that there is the droplet, the intensity of the light beam passing through the droplet may change, and the PIN photodiode at the position where the droplet is located may receive the light beam whose intensity has been changed. However, the PIN photodiode at a position where no droplet is located may receive the light beam whose intensity has not been changed. In this way, it is able to determine the position and the size of the droplet. The collected signal may be transmitted to, and processed by, the control circuit, and then the processed signal may be transmitted to the system terminal. The system terminal may compare the actual movement trajectory with the predetermined movement trajectory in accordance with the processed signal, and transmit a control signal. A voltage signal may be applied by the first TFT 123 to the first sub-electrode 1111, so as to generate the potential difference between the first sub-electrode 1111 and the second electrode 201 and change the contact angle (shrink angle) of the droplet, thereby to change the surface tension of the droplet and control the movement trajectory of the droplet. For example, the droplet may be driven to move toward a position in the electric field generated between the first sub-electrode 1111 and the second electrode 201.

A transparent material layer may cover the PIN photodiode as possible. In an optional embodiment of the present disclosure, each of the first electrode and the second electrode 201 may be made of a transparent conductive material, e.g., indium tin oxide (ITO). Each of the first hydrophobic layer, the second hydrophobic layer and the second base substrate 200 may be made of a transparent material, so as to enable the PIN photodiode to receive a light beam from a light source L, thereby achieving the photovoltaic conversion and collecting the optical signal.

Figure 10A:
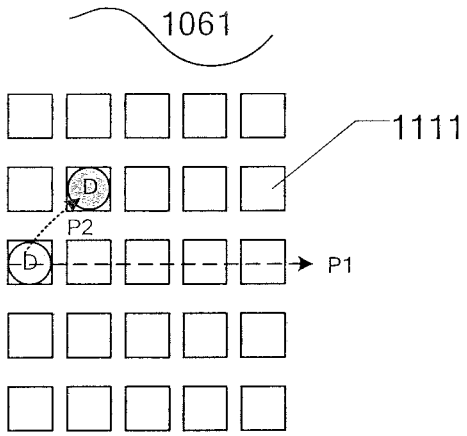
FIG. 10A is a top view showing droplet movement of a microfluidic system according to some embodiments of the present disclosure.
Figure 10B:
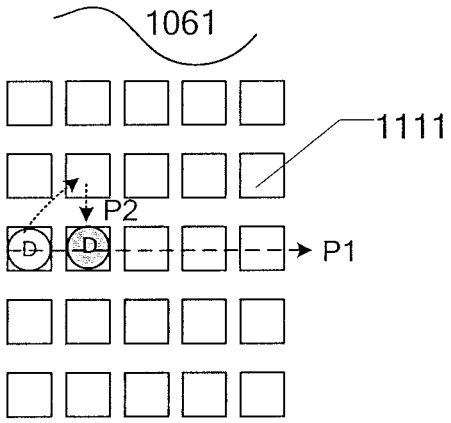
FIG. 10B is a top view showing a droplet moving back to a predetermined movement trajectory according to some embodiments of the present disclosure.
Figure 10C:
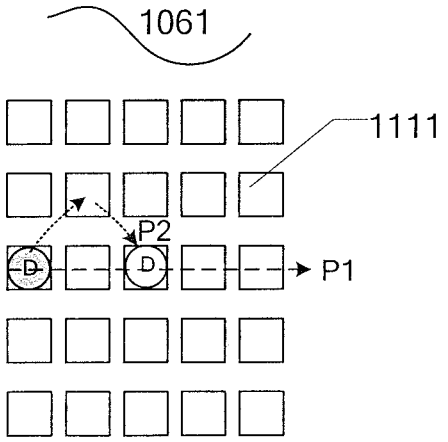
FIG. 10C is a top view showing a droplet moving back to a predetermined movement trajectory according to some other embodiments of the present disclosure.

As shown in FIGS. 10A to 10C, the predetermined movement trajectory P1 is a straight line, and the droplet moves from left to right in the third row of the first sub-electrodes 1111. In the case that a common voltage is applied to the second electrode, it is able to apply the first driving signal to the first sub-electrodes 1111 in the third row and in second, third, fourth and fifth columns sequentially, so as to form the electric fields at the corresponding positions, thereby enabling the droplet D to move from left to right in the third row. In an optional embodiment of the present disclosure, in the case that the driving signal is applied to a current first sub-electrode, no driving signal may be applied to a previous first sub-electrode, but the present disclosure is not limited thereto. Due to the complexity in the movement of the droplet, e.g., due to a time delay of the formation of the electric field or the coupling of the electric fields, the actual movement trajectory P2 of the droplet D may be deviated from the predetermined movement trajectory P1. The droplet detection unit may detect the position of the droplet, and output the detection signal to the second control circuit.

As shown in FIG. 10B, the second control circuit may receive the detection signal from the droplet detection unit, so as to acquire the actual movement trajectory P2 of the droplet D. The signal adjustment unit may compare the actual movement trajectory P2 with the predetermined movement trajectory P1. Because an actual position of the droplet D is in the second row and the second column, and a predetermined position of the droplet D is in the third row, the actual movement trajectory P2 is different from the predetermined movement trajectory P1, and the signal adjustment unit may adjust in real time the first driving signal inputted to the droplet driving unit into the second driving signal. The first driving signal is inputted to the first sub-electrode 1111 in the third row and the third column, and the second driving signal is inputted to the first sub-electrode 1111 in the third row and the second column, so as to pull the droplet vertically downward, thereby to enable the droplet D to move from a position in the second row and the second column to a position in the third row and the second column. At this time, the droplet may move back to the predetermined movement trajectory P1 under the effect of the second driving signal.

In another optional embodiment of the present disclosure, as shown in FIG. 10C, the signal adjustment unit may adjust a direction and an amplitude of the second driving signal inputted to the first sub-electrode 1111 in the third row and the third column, so as to enable the droplet to move along the predetermined movement trajectory P1 again. Due to the second driving signal, the droplet may be pulled obliquely downward, so as to enable the droplet D to move from a position in the second row and the second column to a position in the third row and the third column. At this time, the droplet may move along the predetermined movement trajectory P1 again under the effect of the second driving signal. As compared with FIG. 10B, in FIG. 10C, the amplitude of the second driving signal applied to the first sub-electrode for enabling the droplet to move from the position in the second row and the second column to the position in the third row and the third column is larger than for enabling the droplet to move from the position in the second row and the second column to the position in the third row and the second column, i.e., a larger electric field is generated to facilitate the movement of the droplet back to the predetermined movement trajectory.

The adjustment using the driving method in the embodiments of the present disclosure may be performed in accordance with the practical need, but limited to those shown in FIGS. 10A to 10C. FIGS. 10A to 10C merely illustratively show the first sub-electrodes 1111, and a shape of each first sub-electrode 1111 may be set in accordance with the practical need. In an optional embodiment of the present disclosure, each first sub-electrode 1111 may be of an irregular, e.g., sawtoothed, shape. Actually, a tooth of one first sub-electrode 1111 may be arranged between two adjacent teeth of another first sub-electrode 1111 arranged adjacent to the first sub-electrode 1111. In addition, a shape of each tooth may be of a triangular or rectangular shape.

In the embodiments of the present disclosure, in the case that the droplet moves along the predetermined movement trajectory, the first driving signal may be applied to the first electrode, and in the case that the droplet moves along a trajectory deviated from the predetermined movement trajectory, the second driving signal may be applied to the first electrode. In addition, in the case that the first driving signal and the second driving signal are inputted by a same first sub-electrode, the first driving signal may have an amplitude the same as the second driving signal. In the case that the first driving signal and the second driving signal are inputted by different first sub-electrodes respectively, the first driving signal may have an amplitude different from the second driving signal. In an optional embodiment of the present disclosure, the second driving signal has an amplitude greater than the first driving signal, but the present disclosure is not limited thereto. The first driving signal may also have a direction different from the second driving signal.

The microfluidic system in the embodiments of the present disclosure may further include one or more processors and one or more memories. The processor is configured to process a data signal, and it may include various computational structures, e.g., a complex instruction set computer (CISC) structure, a reduced instruction set computer (RISC) structure or a structure capable of executing various instruction sets. The memory is configured to store the instruction therein and/or data to be executed by the processor. These instructions and/or data may include codes, so as to achieve some or all functions of one or more members described hereinabove. For example, the memory may include a dynamic random access memory (DRAM), a static random access memory (SRAM), a flash memory, an optical memory, or any other memory known in the art.

In an optional embodiment of the present disclosure, the signal adjustment unit may include codes and programs stored in the memory. The processor is configured to execute these codes and programs, so as to achieve some or all the functions of the signal adjustment unit as mentioned above.

In an optional embodiment of the present disclosure, the signal adjustment unit may be a special hardware member configured to achieve some or all functions of the signal adjustment unit as mentioned above. For example, the signal adjustment unit may be a circuit board or a combination of a plurality of circuit boards, so as to achieve the above-mentioned functions. The circuit board or the combination of circuit boards may include: one or more processors; one or more non-transient computer-readable memories connected to the processor; and firmware stored in the memory and capable of being executed by the processor.

The above description is given by taking one droplet as an example. Actually, the microfluidic system and the driving method in the embodiments of the present disclosure may also be used to drive a plurality of droplets simultaneously.

It should be appreciated that, shapes and sizes of the members in the drawings are for illustrative purposes only, but shall not be used to reflect any actual scale. In the case that such an element as layer, film, region or substrate is arranged "on" or "under" another element, it may be directly arranged "on" or "under" the other substrate, or an intermediate element may be arranged therebetween.

In the embodiments of the present disclosure, the term "identical layer" refers to a layer structure formed by patterning a film layer, which is formed through a same film-forming process and used for forming a specific pattern, through a single patterning process using a same mask plate. Depending on the specific patterns, the patterning process may include a plurality of exposing, developing or etching processes. The specific patterns of the formed layer structure may be continuous or discontinuous, and they may be at different levels or have different thicknesses. In addition, the term "posture" may refer to a spatial state of an object.

In addition, the features in the embodiment or embodiments may be combined in any form in the case of no conflict.

The above are merely optional embodiments of the present disclosure, but the present disclosure is not limited thereto. Obviously, a person skilled in the art may make further modifications and improvements without departing from the spirit of the present disclosure, and these modifications and improvements shall also fall within the scope of the present disclosure.

What is claimed is:

1. A microfluidic system, comprising:

a first substrate;

a second substrate arranged opposite to the first substrate;

a droplet flow channel arranged between the first substrate and the second substrate and configured to accommodate a droplet therein;

a droplet driving unit configured to drive the droplet to move in the droplet flow channel;

a first control circuit electrically connected to the droplet driving unit and configured to input a first driving signal to the droplet driving unit to drive the droplet to move along a predetermined movement trajectory;

a droplet detection unit configured to detect the droplet and output a detection signal;

a second control circuit electrically connected to the droplet detection unit and configured to receive the detection signal to acquire an actual movement trajectory of the droplet; and a signal adjustment unit configured to compare the actual movement trajectory with the predetermined movement trajectory, and in the case that the actual movement trajectory is different from the predetermined movement trajectory, adjust, in a real-time manner, the first driving signal inputted to the droplet driving unit into a second driving signal in such a manner that the droplet moves back to the predetermined movement trajectory under the effect of the second driving signal, wherein the droplet driving unit comprises a first electrode and a second electrode in the first substrate and the second substrate respectively, and the first electrode and the second electrode are configured to generate an electric field between the first substrate and the second substrate to drive the droplet to move in the droplet flow channel; and wherein the first electrode comprises a plurality of first sub-electrodes insulated from each other, wherein the droplet detection unit is arranged on the first substrate and comprises a plurality of detection sub-units, and each of the detection sub-units comprises a photosensitive sensor configured to receive a light beam and detect a change in an intensity of the light beam, wherein the microfluidic system further comprises: a plurality of first thin film transistors (TFT) electrically connected to the first sub-electrodes in a one-to-one correspondence; and a plurality of second TFTs electrically connected to the detection sub-units in a one-to-one correspondence, wherein each of the first TFTs comprises a first source electrode, a first drain electrode and a first gate electrode, and each of the second TFTs comprises a second source electrode, a second drain electrode and a second gate electrode; and wherein the first source electrode, the first drain electrode, the second source electrode and the second drain electrode are in a same layer, and the first gate electrode and the second gate electrode are in a same layer.

2. The microfluidic system according to claim 1, further comprising: a buffer circuit, electrically connected to the first source electrode of each first TFT and the first control circuit, and configured to amplify the first driving signal or the second driving signal from the first control circuit.

3. The microfluidic system according to claim 1, further comprising: an integrator circuit, electrically connected to the second source electrode of each second TFT and the second control circuit, and configured to preform analog-to-digital conversion on the detection signal received by the second control circuit.

4. The microfluidic system according to claim 1, wherein each of the detection sub-units comprises a third electrode, a fourth electrode and a photosensitive layer electrically connected to the third electrode and the fourth electrode, the third electrode is electrically connected to the second drain electrode of the second TFT, and the fourth electrode and the first electrode of the droplet driving unit are in a same layer.

5. The microfluidic system according to claim 1, wherein the signal adjustment unit is further configured to adjust the first driving signal into the second driving signal in accordance with at least one of a position or a size of the droplet.

6. The microfluidic system according to claim 1, wherein the first substrate comprises a base substrate, a gate electrode layer, a gate insulation layer, a source and drain electrode layer, a first insulation layer, a second insulation layer, an electrode layer, a third insulation layer and a first hydrophobic layer that are stacked in sequence, the first hydrophobic layer is arranged at a side of the first substrate adjacent to the droplet flow channel, the first gate electrode and the second gate electrode are formed from the gate electrode layer, the first drain electrode, the first source electrode, the second drain electrode and the second source electrode are formed from the source and drain electrode layer, and the fourth electrode of each detection sub-unit and the first electrode of the droplet driving unit are formed from the electrode layer.

7. The microfluidic system according to claim 6, wherein the second substrate comprises a second hydrophobic layer arranged at a side of the second substrate proximate to the first substrate.

8. A driving method for the microfluidic system according to claim 1, wherein the driving method comprises:

inputting, by the first control circuit, the first driving signal to the droplet driving unit to drive the droplet to move in the droplet flow channel along the predetermined movement trajectory;

inputting a detection driving signal to the droplet detection unit, detecting, by the droplet detection unit, the droplet and outputting the detection signal, and receiving, by the second control circuit, the detection signal and acquiring the actual movement trajectory of the droplet in accordance with the detection signal; and comparing, by the signal adjustment unit, the actual movement trajectory with the predetermined movement trajectory, and in the case that the actual movement trajectory is different from the predetermined movement trajectory, adjusting, in a real-time manner, by the signal adjustment unit, the first driving signal inputted to the droplet driving unit into the second driving signal in such a manner that the droplet moves back to the predetermined movement trajectory under the effect of the second driving signal.

9. The driving method according to claim 8, further comprising: increasing a driving capability of the first driving signal or the second driving signal.

10. The driving method according to claim 9, wherein the microfluidic system further comprises a buffer circuit electrically connected to the first control circuit, and wherein subsequent to adjusting, in a real-time manner, by the signal adjustment unit, the first driving signal inputted to the droplet driving unit into the second driving signal, and the driving method further comprises: amplifying, by the buffer circuit, the second driving signal to enable the droplet to move back to the predetermined movement trajectory under the effect of the second driving signal.

11. The driving method according to claim 8, further comprising: performing analog-to-digital conversion on the detection signal.

12. The driving method according to claim 11, wherein the detecting, by the droplet detection unit, the droplet and outputting the detection signal comprises: illuminating the droplet with an ambient light beam or a light beam from an active light source, and detecting, by the photosensitive sensor, the light beam and outputting an optical signal.

13. The driving method according to claim 12, wherein the microfluidic system further comprises an integrator circuit electrically connected to the second control circuit, and wherein the detecting, by the droplet detection unit, the droplet and outputting the detection signal further comprises: converting, by the integrator circuit, the optical signal from the photosensitive sensor into the detection signal, and transmitting the detection signal to the second control circuit.

14. The driving method according to claim 12, wherein the detecting, by the droplet detection unit, the droplet further comprises: detecting, by the droplet detection unit, at least one of a position or a size of the droplet.

15. The driving method according to claim 8, wherein the inputting, by the first control circuit, the first driving signal to the droplet driving unit to drive the droplet to move in the droplet flow channel along the predetermined movement trajectory comprises: inputting, by the first control circuit, the first driving signal to the first electrode and the second electrode to generate an electric field between the first electrode and the second electrode in such a manner that a contact angle of the droplet is adjusted and the droplet is driven to move in the droplet flow channel.

* * * * *